US009384927B2

(12) United States Patent
An

(10) Patent No.: US 9,384,927 B2
(45) Date of Patent: Jul. 5, 2016

(54) ELECTRIC VEHICLE RELAY

(71) Applicant: LSIS CO., LTD., Anyang-si, Gyeonggi-do (KR)

(72) Inventor: Jung Sik An, Seoul (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/705,865

(22) Filed: May 6, 2015

(65) Prior Publication Data

US 2016/0079022 A1 Mar. 17, 2016

(30) Foreign Application Priority Data

Sep. 15, 2014 (KR) ..... 10-2014-0122242

(51) Int. Cl.

| | |
|---|---|
| ***H01H 9/30*** | (2006.01) |
| ***H01H 50/20*** | (2006.01) |
| ***H01H 50/60*** | (2006.01) |
| ***H01H 50/32*** | (2006.01) |

(52) U.S. Cl.

CPC ..... *H01H 50/20* (2013.01); *H01H 9/30* (2013.01); *H01H 50/32* (2013.01); *H01H 50/60* (2013.01); *H01H 2205/002* (2013.01); *H01H 2235/01* (2013.01)

(58) Field of Classification Search

CPC ..... H01H 9/30; H01H 50/20; H01H 50/32; H01H 50/60

USPC ..... 335/201, 228

See application file for complete search history.

(56) References Cited

U.S. PATENT DOCUMENTS

| | | | | |
|---|---|---|---|---|
| 4,725,801 | A * | 2/1988 | Snyder | H01H 51/084 335/122 |
| 5,394,128 | A * | 2/1995 | Perreira | H01H 33/66 335/126 |
| 5,481,236 | A | 1/1996 | Ruehle et al. | |

FOREIGN PATENT DOCUMENTS

| | | |
|---|---|---|
| EP | 2381459 | 10/2011 |
| JP | 49034973 | 3/1974 |
| JP | 2004193099 | 7/2004 |

(Continued)

OTHER PUBLICATIONS

Japan Patent Office Application No. 2015-108333, Office Action dated Mar. 1, 2016, 2 pages.

(Continued)

*Primary Examiner* — Ramon A Barrera

(74) *Attorney, Agent, or Firm* — Lee, Hong, Degerman, Kang & Waimey; Jonathan Kang; Harry Lee

(57) ABSTRACT

An electric vehicle relay includes: a pair of fixed electrodes; a movable electrode movable to contact or to be separated from the fixed electrode; a driving shaft which performs a vertical motion as an upper end thereof is coupled to the movable electrode; a fixed core fitted into a central part of the driving shaft with a gap; a movable core coupled to a lower end of the driving shaft and sucked by a magnetic force of the fixed core; and a cylinder configured to insertion-support the fixed core and the movable core, wherein locking protrusions are formed on an outer circumferential surface of the movable core, wherein inclined grooves for inserting the locking protrusions are formed on an inner circumferential surface of the cylinder, and wherein the movable electrode is rotated as the locking protrusions are moved along the inclined grooves when the movable core performs an up-down motion.

4 Claims, 9 Drawing Sheets

(56) References Cited

FOREIGN PATENT DOCUMENTS

| | | |
|---|---|---|
| JP | 2007287526 | 11/2007 |
| WO | 2014093045 | 6/2014 |

OTHER PUBLICATIONS

European Patent Office Application No. 15166760.7, Search Report dated Feb. 10, 2016, 5 pages.

* cited by examiner

ELECTRIC VEHICLE RELAY

CROSS-REFERENCE TO RELATED APPLICATION

Pursuant to 35 U.S.C. §119(a), this application claims the benefit of earlier filing date and right of priority to Korean Application No. 10-2014-0122242, filed on Sep. 15, 2014, the contents of which are all hereby incorporated by reference herein in its entirety.

BACKGROUND OF THE INVENTION

1. Field of the Invention

The present invention relates to an electric vehicle (EV) relay, and more particularly, to an electric vehicle relay capable of extinguishing an arc generated between a movable electrode and a fixed electrode by extending the arc in a mechanical manner.

2. Background of the Invention

Generally, a direct current (DC) relay or a electromagnetic contactor is a type of electric circuit switching apparatus for performing a mechanical driving and transmitting a current signal using a principle of an electromagnet. The DC relay or the electromagnetic contactor is installed at various types of industrial equipment, machines, vehicles, etc. Especially, a relay for an electric car may switch a conducted state of a main current by being positioned at a battery system.

FIG. 1 is a longitudinal section view of an electric vehicle (EV) relay in accordance with the conventional art. FIG. 2 is a horizontal section view illustrating a magnetic field of a contact part of an EV relay in accordance with the conventional art. FIG. 3 is a partial perspective view illustrating a contact part of an EV relay in accordance with the conventional art.

A direct current (DC) relay for an electric car includes an outer case 1, a arc chamber 2 installed in the outer case 1, a pair of fixed contacts 3 fixedly-installed at the arc chamber 2, and a movable contact 4 movable to contact or be separated from the fixed contacts 3. The DC relay generally includes an electric actuator for driving the movable contact 4 so that switching of contacts can be controlled by an external power. The actuator includes a driving shaft 5 coupled to the movable contact 4, a fixed core 6, a movable core 7, a coil 8, etc. A permanent magnet 9 is provided in the arc chamber 2 so as to effectively control an arc generated between the fixed contact 3 and the movable contact 4 during a current interruption operation.

The fixed contacts 3 are configured as a main contact terminals having polarities of (+) and (−). A magnetic field generated from the permanent magnet 9 performs an interaction with a current, thereby generating a force by Fleming's left-hand law. Thus, the magnetic field pushes out an arc generated during a switching operation, so that damage of a contact part can be reduced.

FIG. 2 illustrates a polarity of a contact and an operation of a force by the permanent magnet 9. A magnetic field (B) toward an S-pole from an N-pole is applied to the permanent magnet 9. An electric force (+I) is generated from the right fixed contact 3, in a exiting direction perpendicular to the drawings. An electric force (−I) is generated from the left fixed contact 3, in a entering direction perpendicular to the drawings. Thus, an arc receives forces (F, F') in an outer direction right and left according to Fleming's left-hand law, so that damage applied to the contact part can be prevented.

In the conventional EV relay, a magnetic field generated by the permanent magnet 9 extinguishes an arc generated between the fixed contacts 3 and the movable contact 4, in an extending manner.

However, the conventional EV relay has the following problems.

Firstly, since a permanent magnet should be provided, production costs are increased.

Secondly, a magnetic field generated from the permanent magnet 9 increases an electronic repulsive force by Fleming's left-hand law, together with a direction of a current flowing on the movable contact 4 as the fixed contacts 3 and the movable contact 4 come in contact with each other.

This will be explained in more detail with reference to FIG. 3. A current (I) flows from a left movable contact 4*a* to a right movable contact 4*b*. Thus, a force (F1) is applied to the movable contact 4 in a downward direction, i.e., a direction to separate the movable contact 4 from the fixed contacts 3 according to Fleming's left-hand law. Due to such an electronic repulsive force, an inferior contact state occurs.

SUMMARY OF THE INVENTION

Therefore, an aspect of the detailed description is to provide an electric vehicle relay capable of extinguishing an arc generated between a movable electrode and a fixed electrode by extending the arc in a mechanical manner.

To achieve these and other advantages and in accordance with the purpose of this specification, as embodied and broadly described herein, there is provided an electric vehicle relay, including: a pair of fixed electrodes; a movable electrode movable to contact or to be separated from the fixed electrode; a driving shaft which performs a vertical motion as an upper end thereof is coupled to the movable electrode; a fixed core fitted into a central part of the driving shaft with a gap; a movable core coupled to a lower end of the driving shaft and sucked by a magnetic force of the fixed core; and a cylinder configured to insertion-support the fixed core and the movable core, wherein locking protrusions are formed on an outer circumferential surface of the movable core, wherein inclined grooves for inserting the locking protrusions are formed on an inner circumferential surface of the cylinder, and wherein the movable electrode is rotated as the locking protrusions are moved along the inclined grooves when the movable core performs an up-down motion.

The locking protrusions may be formed as a pair of locking protrusions symmetric to each other right and left, and the inclined grooves may be also formed as a pair corresponding to the pair of locking protrusions.

A height of the inclined grooves may correspond to a movement distance of the movable core.

A rotation angle of the movable electrode may be 90°.

The EV relay according to an embodiment of the present invention has the following advantages.

Firstly, since an arc generated between the movable contact and the fixed contacts is mechanically extended by rotation of the movable electrode, an arc extinguishing function can be enhanced.

Secondly, since a permanent magnet conventionally used to extinguish an arc is removed, increase of an electronic repulsive force occurring on a movable electrode by the permanent magnet can be prevented. Further, production costs can be reduced since no permanent magnet is used.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of preferred configurations of an electric vehicle (EV) relay according to the present invention, with reference to the accompanying drawings.

Figure 1:
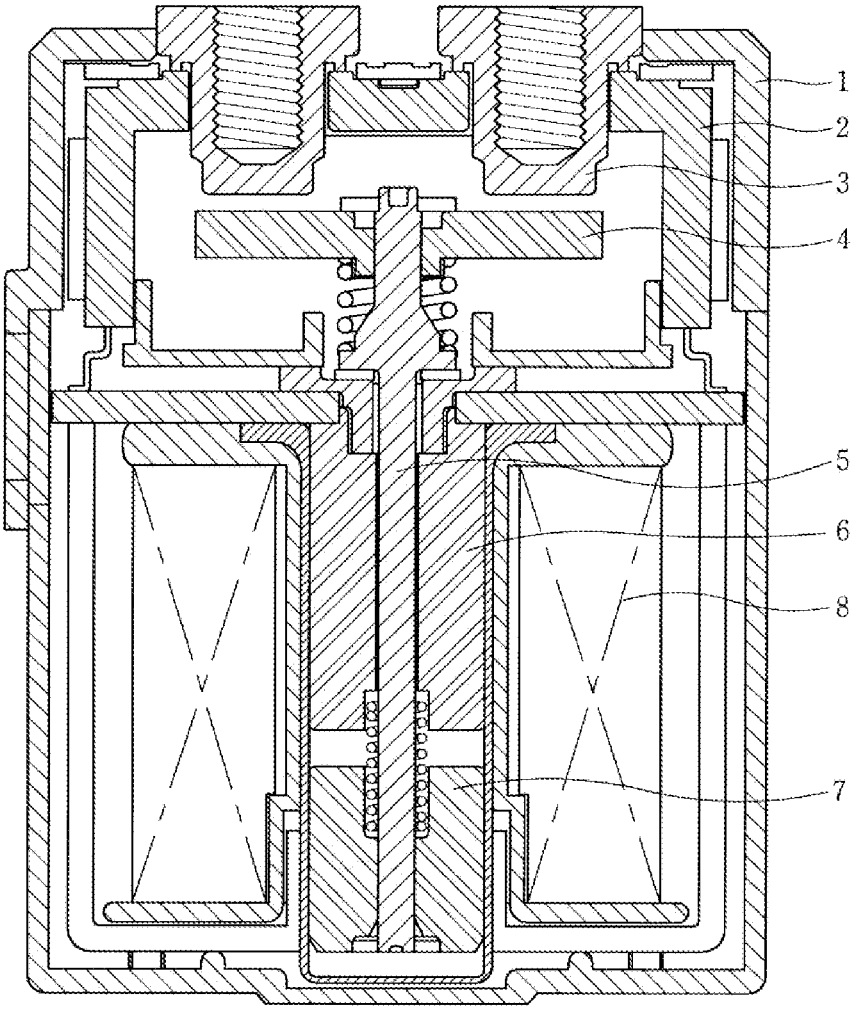
FIG. 1 Prior Art
FIG. 1 is a longitudinal section view of an electric vehicle (EV) relay in accordance with the conventional art.
Figure 2:
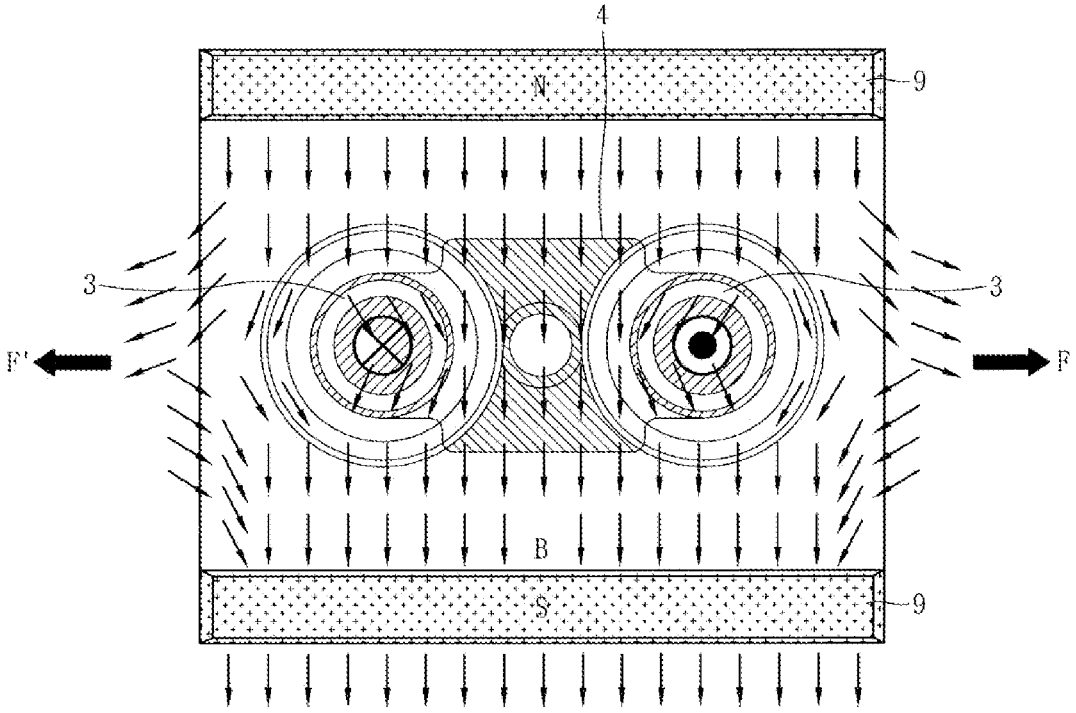
FIG. 2 Prior Art
FIG. 2 is a horizontal section view illustrating a magnetic field of a contact part of an EV relay in accordance with the conventional art.
Figure 3:
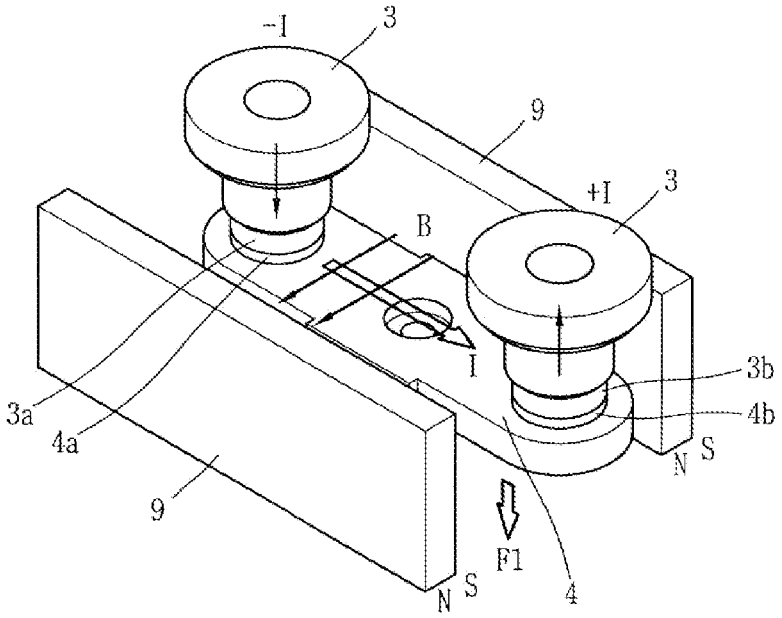
FIG. 3 Prior Art
FIG. 3 is a partial perspective view illustrating a contact part of an EV relay in accordance with the conventional art.
Figure 4:
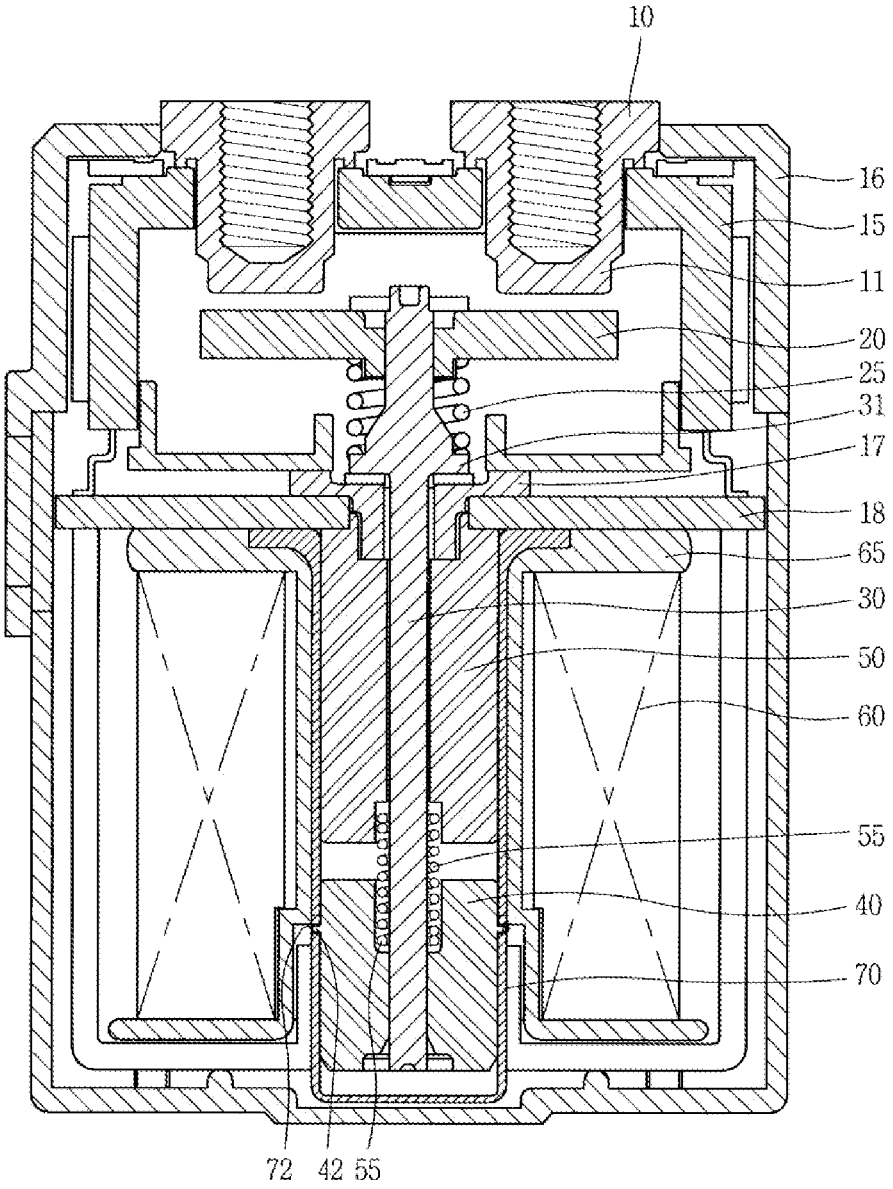
FIG. 4 is a longitudinal section view of an EV relay according to an embodiment of the present invention.
Figure 5:
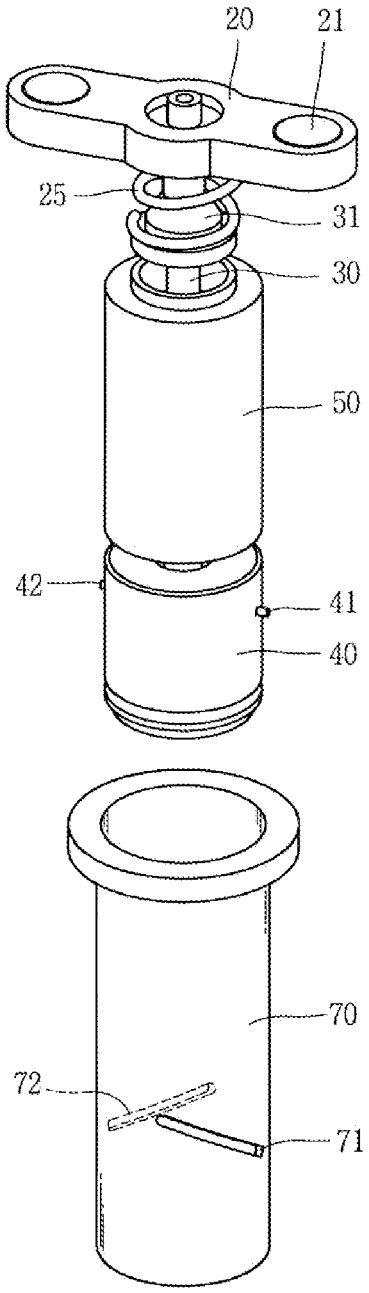
FIG. 5 is a partial perspective view illustrating an inner part of an EV relay according to an embodiment of the present invention.
Figure 6A:
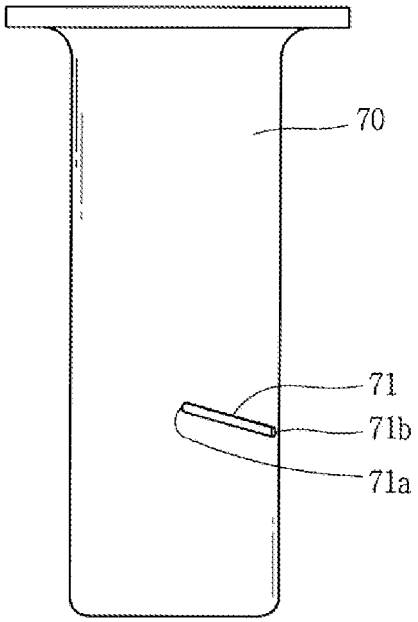
FIGS. 6A and 6B are right and left sectional views of a cylinder in FIG. 5.
Figure 6B:
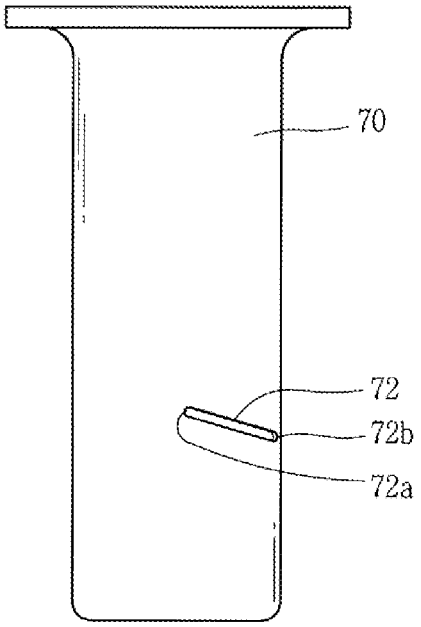

FIG. 4 is a longitudinal section view of an EV relay according to an embodiment of the present invention. FIG. 5 is a partial perspective view illustrating an inner part of an EV relay according to an embodiment of the present invention. FIGS. 6A and 6B are right and left sectional views of a cylinder in FIG. 5.

The EV relay according to an embodiment of the present invention includes a pair of fixed electrodes 10, a movable electrode 20 movable to contact or to be separated from the fixed electrode 10, a driving shaft 30 which performs a vertical motion as an upper end thereof is coupled to the movable electrode 20, a fixed core 50 fitted into a central part of the driving shaft 30 with a gap, a movable core 40 coupled to a lower end of the driving shaft 30 and sucked by a magnetic force of the fixed core 50, and a cylinder 70 configured to insertion-support the fixed core 50 and the movable core 40. Locking protrusions 41, 42 are formed on an outer circumferential surface of the movable core 40, and inclined grooves 71, 72 for inserting the locking protrusions 41, 42 are formed on an inner circumferential surface of the cylinder 70. The movable electrode 20 is rotated as the locking protrusions 41, 42 are moved along the inclined grooves 71, 72 when the movable core 40 performs an up-down motion.

The fixed electrode 10 is provided as one pair, and the pair of fixed electrodes 10 are coupled to an upper part of an arc chamber 15. The pair of fixed electrodes 10 are connected to a power side and a load side, respectively. A connection terminal may be coupled to a groove formed above the fixed electrodes 10. Fixed contacts 11 may be formed below the fixed electrodes 10 to thus contact the movable electrode 20.

The movable electrode 20 is a plate-shaped electrode inserted into the arc chamber 15 and contactable or separable to/from the fixed electrodes 10. A movable contact 21 is formed on an upper surface of the movable electrode 20 where the movable contact 21 directly contacts the fixed contacts 11. If the movable electrode 20 is upward moved to contact the fixed electrodes 10, a current is supplied to a load side from a power side. On the other hand, if the movable electrode 20 is downward moved to be separated from the fixed electrodes 10, the power supply from the power side to the load side is cut off.

The driving shaft 30 is coupled to a central part of the movable electrode 20. The movable electrode 20 is fixed to the driving shaft 30, and moves along the driving shaft 30. As the driving shaft 30 is linearly driven in a shaft direction, the movable electrode 20 contacts or is separated from the fixed electrodes 10.

The driving shaft 30 has a bar shape, and is vertically installed at a central part inside a case 16. The movable electrode 20 is fixedly-coupled to an upper end of the driving shaft 30, and the movable core 40 is fixedly-coupled to a lower end of the driving shaft 30. That is, the driving shaft 30 is moved together with the movable electrode 20 and the movable core 40. More specifically, motion of the movable core 40 is transmitted to the movable electrode 20 through the driving shaft 30.

A flange portion 31 is formed above the driving shaft 30. A compression spring 25 is located between the flange portion 31 and the movable electrode 20, thereby providing an elastic force to the movable electrode 20. The flange portion 31 also serves as a locking jaw which prevents the driving shaft 30 from being moved downward by being locked to an upper end of a supporting body 17.

The fixed core 50 is installed at a central part of the driving shaft 30. A hole formed along a central shaft of the fixed core 50 has an outer diameter larger than that of the driving shaft 30. Thus, the fixed core 50 and the driving shaft 30 do not come in contact with each other.

A coil 60 is wound around a bobbin 65, and generates a magnetic field when a power is applied thereto. By the magnetic field, the fixed core 50 is magnetized to suck the movable core 40.

A groove is formed below the fixed core 50 and above the movable core 40, respectively. A return spring 55 is insertion-installed between the groove and an outer surface of the driving shaft 30.

The movable core 40 is formed in a cylindrical shape having the same diameter as the fixed core 40. The movable core 40 is moved upward by a magnetic force generated between the coil 60 and the fixed core 50. If an external power applied to the coil 60 is cut off, a magnetic force is not generated from the fixed core 50. Thus, the movable core 40 is separated from the fixed core 50 by the return spring 55 to thus be downward-moved to an initial position.

The locking protrusions 41, 42 protrude from two side surfaces of the movable core 40, respectively. When viewed from a sectional surface, the locking protrusions 41, 42 may be formed in a symmetric manner by 180°.

The cylinder 70 serves as a space where the fixed core 50 and the movable core 40 are to be inserted, and provides a supporting force to the fixed core 50 and the movable core 40.

The inclined grooves 71, 72 for inserting the locking protrusions 41, 42 are formed on an inner side surface of the cylinder 70. The inclined grooves 71, 72 may be formed as one pair corresponding to the locking protrusions 41, 42.

The inclined grooves 71, 72 may be formed so that a height thereof can be equal to a movement distance (stroke) of the movable core 40. A movement distance of the movable electrode 20 may be shorter than that of the movable core 40. The reason is in order to make the movable electrode 20 stably contact the fixed electrode 10 by the contact force of the compression spring 25.

A circular arc formed as the inclined grooves 72, 73 are projected onto a horizontal surface may have an angle of 90°. Thus, a rotation angle of the movable electrode 20 may be 90°.

The bobbin 65 is formed in a cylindrical shape having flanges at two ends thereof. The coil 60 is wound between the flanges of the bobbin 65. A through hole, into which the cylinder 70 is to be inserted, is formed at a central part of the bobbin 65.

A yoke 18 is formed in a shape to enclose two ends of the bobbin 65 and side surfaces of the coil 60 wound on the bobbin 65.

An operation of the EV relay according to an embodiment of the present invention will be explained.

Figure 7A:
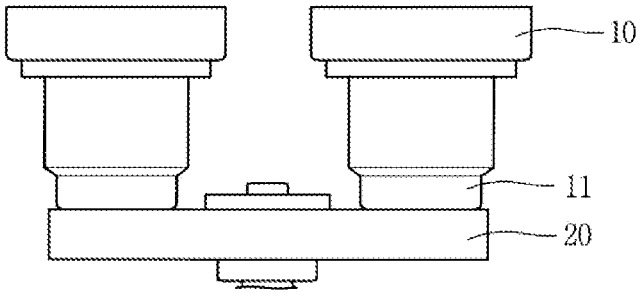
FIGS. 7A and 7B are a frontal view and a planar view illustrating a contacted state between a movable electrode and a fixed electrode, which shows an operation of an EV relay according to an embodiment of the present invention.
Figure 7B:
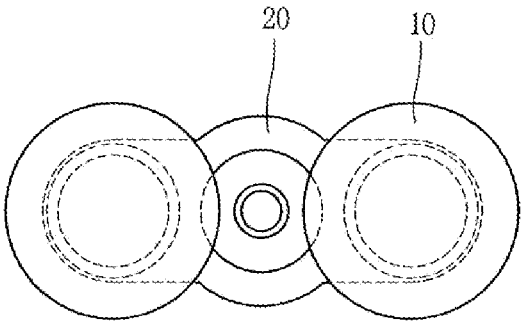
Figure 8A:
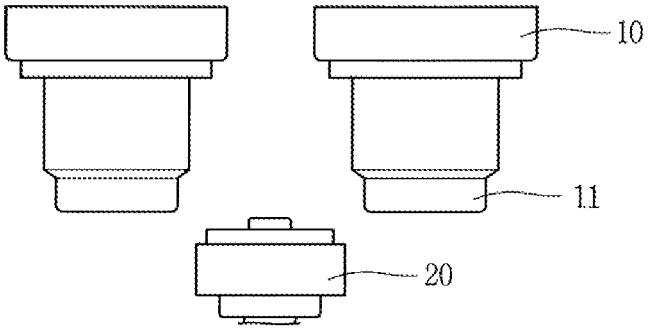
FIGS. 8A and 8B are a frontal view and a planar view illustrating a separated state between a movable electrode and a fixed electrode, which shows an operation of an EV relay according to an embodiment of the present invention.
Figure 8B:
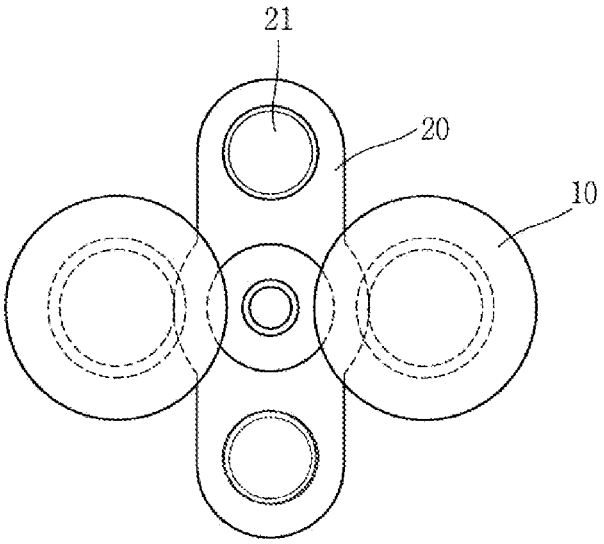

FIGS. 7A and 7B are a frontal view and a planar view illustrating a contacted state between a movable electrode and a fixed electrode, which shows an operation of an EV relay according to an embodiment of the present invention. FIGS. 8A and 8B are a frontal view and a planar view illustrating a separated state between a movable electrode and a fixed electrode, which shows an operation of an EV relay according to an embodiment of the present invention.

The movable electrode 20 is moved upward to thus be in a contacted state to the fixed electrodes 10. In this state, the right locking protrusion 41 is disposed at an upper end 71*a* of the right inclined groove 71. If a magnetic force generated from the coil 60 and the fixed core 50 becomes weak as an external power is cut-off, the movable core 40 is separated from the fixed core 50 by an elastic force of the return spring 55, thereby being moved downward to the original position. Since the right locking protrusion 41 of the movable core 40 moves along the right inclined groove 71, the movable core 40 is rotated. The movable core 40 is moved downward, until the right locking protrusion 41 reaches a lower end 71*b* of the right inclined groove 71. A height of the right inclined groove 71 corresponds to an up-down movement distance of the movable core 40 and the movable electrode 20. The movable electrode 20 is rotated with being moved downward together with the movable core 40. Preferably, the movable electrode 20 is rotated by 90°.

The left locking protrusion 42 and the left inclined groove 72 are operated in the same manner as the right locking protrusion 41 and the right inclined groove 71. In a contacted state between the movable electrode 20 and the fixed electrodes 10, the left locking protrusion 42 is disposed at an upper end 72*a* of the left inclined groove 72. If the movable core 40 is moved downward, the left locking protrusion 42 is moved along the left inclined groove 72 and thus the movable core 40 is rotated. As a result, the movable electrode 20 is also rotated to be separated from the fixed electrodes 10.

The movable electrode 20 is rotated by 90° when separated from the fixed electrodes 10. As a result, the movable contact 21 becomes far from the fixed contacts 11, and thus an arc is extended to be extinguished.

The EV relay according to an embodiment of the present invention has the following advantages.

Firstly, since an arc generated between the movable contact 21 and the fixed contacts 11 is extended mechanically by rotation of the movable electrode 20, an arc extinguishing function can be enhanced.

Secondly, since a permanent magnet conventionally used to extinguish an arc is removed, increase of an electronic repulsive force occurring on a movable electrode by the permanent magnet can be prevented. Further, production costs can be reduced since no permanent magnet is used.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An electric vehicle relay, comprising:

a pair of fixed electrodes;

a movable electrode movable to contact or to be separated from the fixed electrode;

a driving shaft which performs a vertical motion as an upper end thereof is coupled to the movable electrode;

a fixed core fitted into a central part of the driving shaft with a gap;

a movable core coupled to a lower end of the driving shaft and sucked by a magnetic force of the fixed core; and a cylinder configured to insertion-support the fixed core and the movable core, wherein locking protrusions are formed on an outer circumferential surface of the movable core, wherein inclined grooves for inserting the locking protrusions are formed on an inner circumferential surface of the cylinder, and wherein the movable electrode is rotated as the locking protrusions are moved along the inclined grooves when the movable core performs an up-down motion.

2. The electric vehicle relay of claim 1, wherein the locking protrusions are formed as a pair of locking protrusions symmetric to each other right and left, and wherein the inclined grooves are also formed as a pair corresponding to the pair of locking protrusions.

3. The electric vehicle relay of claim 1, wherein a height of the inclined grooves corresponds to a movement distance of the movable core.

4. The electric vehicle relay of claim 1, wherein a rotation angle of the movable electrode is 90°.

* * * * *